US011607007B2

(12) United States Patent
Brown et al.

(10) Patent No.: US 11,607,007 B2
(45) Date of Patent: Mar. 21, 2023

(54) INSOLE AND OUTSOLE TWO-PIECE SHOE

(71) Applicant: Oofos, Inc., Braintree, MA (US)

(72) Inventors: Paul Brown, Cohasset, MA (US); Juan Diaz, Lake Oswego, OR (US)

(73) Assignee: Oofos, Inc., Braintree, MA (US)

( * ) Notice: Subject to any disclaimer, the term of this patent is extended or adjusted under 35 U.S.C. 154(b) by 499 days.

(21) Appl. No.: 15/801,844

(22) Filed: Nov. 2, 2017

(65) Prior Publication Data

US 2019/0125030 A1 May 2, 2019

(51) Int. Cl.

| | |
|---|---|
| ***A43B 13/16*** | (2006.01) |
| ***A43B 23/02*** | (2006.01) |
| ***A43B 13/04*** | (2006.01) |
| ***A43B 13/14*** | (2006.01) |
| ***A43B 13/32*** | (2006.01) |
| ***A43B 13/02*** | (2022.01) |
| ***A43B 13/18*** | (2006.01) |
| ***A43B 7/32*** | (2006.01) |
| ***A43D 999/00*** | (2006.01) |
| ***A43B 9/12*** | (2006.01) |
| ***A43B 13/12*** | (2006.01) |
| ***A43B 13/38*** | (2006.01) |
| *A43B 5/00* | (2022.01) |

(52) U.S. Cl.

CPC ..... *A43B 13/16* (2013.01); *A43B 7/32* (2013.01); *A43B 9/12* (2013.01); *A43B 13/023* (2013.01); *A43B 13/04* (2013.01); *A43B 13/12* (2013.01); *A43B 13/141* (2013.01); *A43B 13/145* (2013.01); *A43B 13/187* (2013.01); *A43B 13/32* (2013.01); *A43B 13/38* (2013.01); *A43B 23/0215* (2013.01); *A43D 999/00* (2013.01); *A43B 5/00* (2013.01); *A43D 2200/00* (2013.01)

(58) Field of Classification Search

CPC ..... A43B 13/12–13/16; A43B 3/12–3/128
See application file for complete search history.

(56) References Cited

U.S. PATENT DOCUMENTS

| | | | |
|---|---|---|---|
| 2,695,464 | A | 11/1954 | Sherman |
| 3,568,340 | A | 3/1971 | Gardner |
| 4,128,950 | A | 12/1978 | Bowerman et al. |
| 4,354,318 | A | 10/1982 | Frederick et al. |
| 4,430,810 | A | 2/1984 | Bente |

(Continued)

FOREIGN PATENT DOCUMENTS

| | | |
|---|---|---|
| CN | 104939423 A | 9/2015 |
| WO | WO 01/82734 | 11/2001 |

OTHER PUBLICATIONS

Amazon.com, Inc., Amazon Fashion—"Soft Sole Shoes" Orgrimmar Baby Boys Girls First Walkers Soft Sole Leather Baby Shoes, 6 pages, 1996-1997.

(Continued)

*Primary Examiner* — Jila M Mohandesi
(74) *Attorney, Agent, or Firm* — Sunstein LLP

(57) ABSTRACT

An article of footwear includes an injection molded outsole of a first material having a durometer reading of at least 28 to at most 38 on the Asker C scale, an injection molded insole of a second material having a durometer reading of at least 28 to at most 38 on the Asker C scale, and an upper, at least a section of a peripheral edge of the upper being sandwiched between the insole and the outsole.

11 Claims, 5 Drawing Sheets

(56) References Cited

U.S. PATENT DOCUMENTS

| | | | | |
|---|---|---|---|---|
| 4,815,221 | A * | 3/1989 | Diaz | A43B 13/183 36/27 |
| 4,843,736 | A * | 7/1989 | Courian | A43B 3/105 36/11.5 |
| 4,852,273 | A | 8/1989 | Hamy | |
| 4,918,841 | A | 4/1990 | Turner et al. | |
| 4,920,664 | A | 5/1990 | McGregor et al. | |
| 5,438,767 | A * | 8/1995 | Stein | A43B 3/12 36/11.5 |
| 5,491,909 | A * | 2/1996 | Darby | A43B 11/00 36/110 |
| 5,572,805 | A | 11/1996 | Giese et al. | |
| 5,718,064 | A | 2/1998 | Pyle | |
| 6,035,554 | A | 3/2000 | Duncan | |
| 6,418,642 | B1 * | 7/2002 | Bigg | A43B 3/102 12/142 S |
| 6,601,042 | B1 | 7/2003 | Lyden | |
| 7,082,703 | B2 | 8/2006 | Greene et al. | |
| 7,231,728 | B2 * | 6/2007 | Darby | A43B 3/128 36/100 |
| 7,234,251 | B2 * | 6/2007 | Fuerst | A43B 1/0027 36/11.5 |
| 7,845,095 | B2 * | 12/2010 | Langvin | A43B 13/189 36/154 |
| 8,230,619 | B2 * | 7/2012 | Salvatelli | A43B 1/0045 36/110 |
| 8,671,592 | B2 | 3/2014 | Dojan | |
| 8,707,587 | B2 | 4/2014 | Christensen et al. | |
| 9,125,451 | B2 | 9/2015 | Pham | |
| 2004/0083622 | A1 | 5/2004 | Mizrahi et al. | |
| 2005/0060914 | A1 * | 3/2005 | Fuerst | A43B 1/14 36/102 |
| 2009/0307925 | A1 | 12/2009 | Pfister | |
| 2012/0137540 | A1 | 6/2012 | Vattes et al. | |
| 2014/0237857 | A1 | 8/2014 | Seabra | |
| 2014/0259738 | A1 * | 9/2014 | Yen | A43B 3/122 36/11.5 |
| 2015/0143723 | A1 | 5/2015 | Tateishi et al. | |
| 2015/0181975 | A1 | 7/2015 | Otsuka et al. | |
| 2015/0237957 | A1 * | 8/2015 | Cross | A43B 13/14 36/30 R |
| 2015/0289590 | A1 * | 10/2015 | Jones | A43B 13/38 36/83 |
| 2016/0374425 | A1 * | 12/2016 | Hau | A43B 5/001 36/127 |
| 2017/0150777 | A1 * | 6/2017 | Youngs | A43B 7/20 |
| 2017/0267845 | A1 * | 9/2017 | Baghdadi | C08L 23/14 |
| 2018/0338571 | A1 * | 11/2018 | Cross | A43B 13/186 |

OTHER PUBLICATIONS

Amazon.com, Inc., Amazon Fashion—"Soft Sole Shoes" Juan Men's Running Shoes Fashion Breathable Sneakers Mesh Soft Sole Casual Athletic Lightweight, 6 pages, 1996-2017.

Anonymous, *Durometer—How Shoes are Made—The Sneaker Factory*, Mar. 14, 2015, XP055514681, retrieved from the Internet: URL:https://web.archive.org/web/20160917110951/https://Sneakerfactory.net/sneakers/Shoe_Terms/durometer/ [retrieved on Oct. 11, 2018]; 14 pages.

International Searching Authority/European Patent Office, International Search Report and the Written Opinion of the International Searching Authority, Application No. PCT/US2018/041209, dated Dec. 4, 2018, 16 pages.

Chinese Patent Office, Third office action issued in CN application No. 201880071482.6, dated Nov. 29, 2021, 4 pages.

* cited by examiner

INSOLE AND OUTSOLE TWO-PIECE SHOE

TECHNICAL FIELD

The present invention relates to articles of footwear, and more particularly to shoes featuring two-layered soles.

BACKGROUND ART

Traditional shoe soles usually have a three-layered structure. They include an outsole, a midsole, and an insole. The outsole provides the shoe with an outer profile so that it meets the requirements of good grip with the ground, and is typically a hard layer made of a high-density material to assure high wear resistance and a long lifetime of the sole. The midsole is typically made of a softer material with a lower density than the outsole. Based on the ability of the midsole material to deform reversibly, it absorbs or dampens mechanical impacts which are generated during the walking and running motions and which are transmitted to the body of the shoe wearer via the shoe. The insole acts as an adapter between the flat surface of the shoe and the three-dimensional shape of the foot. Usually, a sock liner is laid on top of the insole to provide enhanced comfort and better support.

SUMMARY OF THE EMBODIMENTS

In accordance embodiments of the invention, there is provided an article of footwear having an injection molded outsole of a first material having a durometer reading of at least 28 to at most 38 on the Asker C scale, an injection molded insole of a second material having a durometer reading of at least 28 to at most 38 on the Asker C scale, and an upper. At least a section of a peripheral edge of the upper is sandwiched between the insole and the outsole.

The first material may be polymeric foam and/or the second material may be the same as the first material. The insole and the outsole are preferably comparable in thickness, neither being more than twice as thick as the other. In any of the embodiments of the footwear, an adhesive may be used to fasten an upper surface of the outsole to the lower surface of the insole. In any of the embodiments of the footwear, the lower face of the outsole may include a rocker shape. In any of the embodiments of the footwear, the upper may be made of an elastomeric material. In any of the embodiments of the footwear, a recess may be included in the upper surface of the outsole and/or in the lower surface of the insole to receive the peripheral edge of the upper.

Notably, the footwear is made without a hard layer under the outsole. Any embodiments of the footwear can be made without a sock liner and/or without a midsole between the outsole and insole.

A method for manufacturing an article of footwear in accordance with further embodiments of the invention includes injection molding an outsole of a first material having a durometer reading of at least 28 to at most 38 on the Asker C scale, injection molding an insole of a second material having a durometer reading of at least 28 to at most 38 on the Asker C scale, fastening an upper surface of the outsole to a lower surface of the insole, and sandwiching at least a section of an outer peripheral edge of an upper between the insole and the outsole.

BRIEF DESCRIPTION OF THE DRAWINGS

The foregoing features of embodiments will be more readily understood by reference to the following detailed description, taken with reference to the accompanying drawings, in which.

DETAILED DESCRIPTION OF SPECIFIC EMBODIMENTS

Definitions. As used in this description and the accompanying claims, the following terms shall have the meanings indicated, unless the context otherwise requires:

- The term "thickness" when in reference to a layer such as a shoe insole or outsole means the maximum thickness as measured along a vertical axis drawn between a first point on the upper surface of the layer and a second point on the bottom surface of the layer.
- The term "durometer reading" of a material refers to a durometer reading on the Asker C scale.
- The term "hard layer" refers to a layer of a material having a durometer reading of more than 38 on the Asker C scale.
- The term "elastomer" refers to a polymer that displays rubber-like elasticity (*Pure Appl. Chem.*, Vol. 79, No. 10, pp. 1801-1829, 2007).

Provided herein is a novel and improved type of shoe architecture featuring an outsole which is directly fastened to an insole, in the absence of a midsole. It has been found that, in instances where the outsole and insole are of materials having a hardness falling within a certain range, a comfortable and wear-resistant shoe is obtained with no need for a hard outsole or a sock liner.

Figure 1:
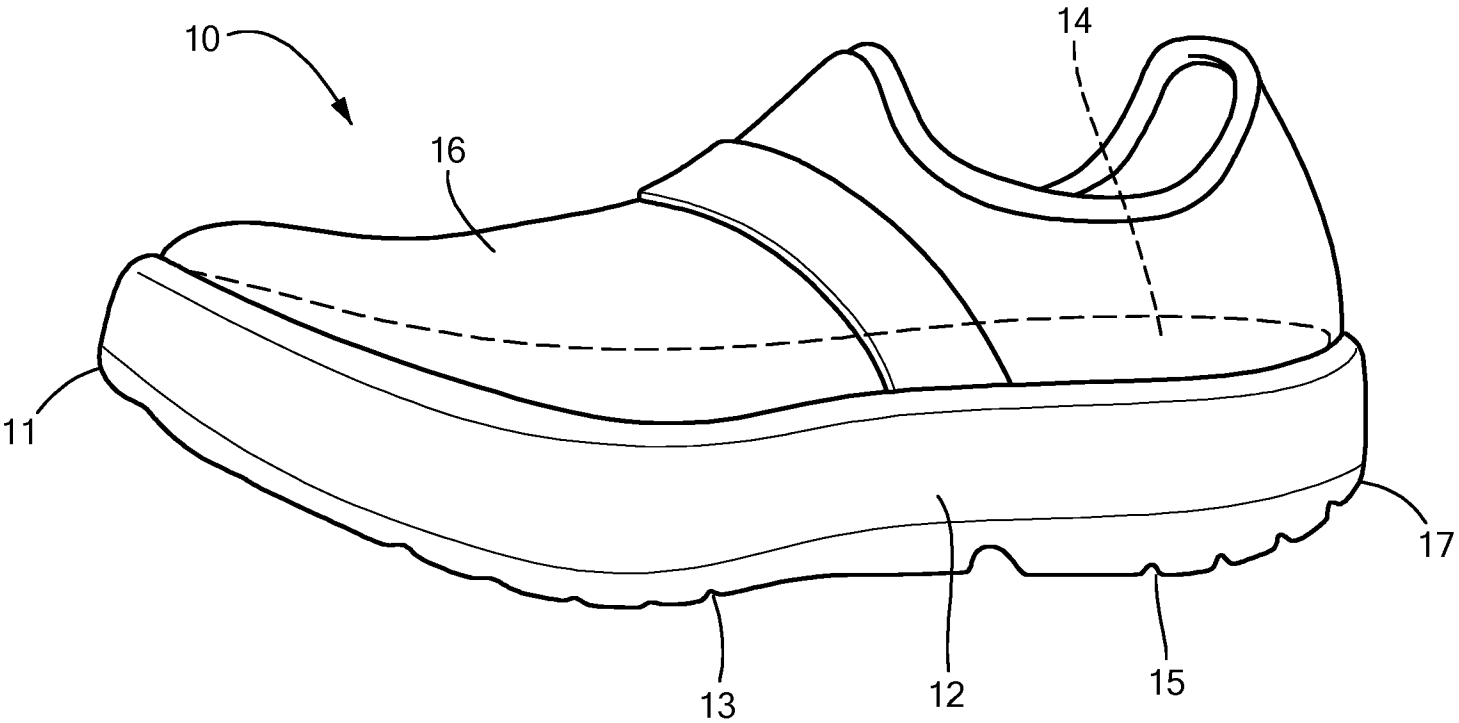
FIG. 1 is a front perspective view of an example shoe according to an embodiment of the invention.
Figure 2:
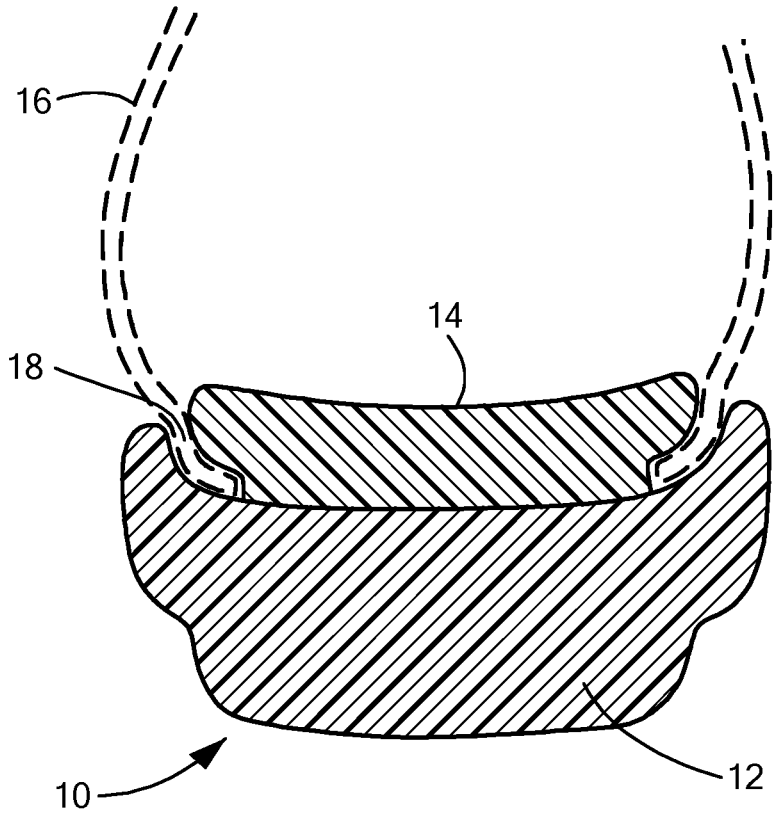
FIG. 2 is a cross-section of the shoe of FIG. 1.

FIG. 1 illustrates a shoe 10 according to an exemplary embodiment of the present invention, including an outsole 12, an insole 14 and an upper 16. FIG. 2 is a cross-section of shoe 10 illustrating that at least a portion of the outer edge 18 of upper 16 is sandwiched between the outsole 12 and insole 14, providing a simple yet durable attachment of the upper to the rest of the shoe. The outsole 12 is made of a first material having a durometer reading of at least 28 to at most 38 on the Asker C scale. The ratio $T_1$:$T_2$, $T_1$ being the thickness of the insole 14 and $T_2$ that of the outsole 12, is in the range of at most 5:1 to at most 1:5; in some embodiments, the ratio is in a range of at most 3:1 to at least 1:3; in other embodiments, the ratio is in a range of at most 2:1 to at least 1:2, or at most 1.5:1 to at least 1:1.5, or at most 1.25 to least 1:1.25, or of about 1:1.

It has been found that when the outsole durometer reading and the $T_1$:$T_2$ ratio are within the above respective ranges, the amount of wear is not significantly higher than in the case of traditional, harder outsoles. It is believed that the above sole structure is sufficiently resilient to provide adequate support to the wearer's foot while being just soft enough to mold itself to the walked-on surface, thereby minimizing abrasion and outsole surface wear even if a hard layer outsole is lacking. The insole 14 is made of a second material also having a durometer reading of at least 28 to at most 38 on the Asker C scale. It has been found that the combination of the outsole and insole being in the above durometer range affords comfortable foot support and dispenses with the need for a sock liner between the insole and the foot.

The first material and second material may be the same or different, and each may include one or more polymeric materials, for example injection molded polymeric foams having durometer readings within the ranges disclosed above. Representative polymeric foams include ethylene-vinyl acetate (EVA) foam, also referred to as polyethylene-vinyl acetate (PEVA) foam; low-density polyethylene (LDPE) foam; nitrile rubber (NBR) foam; neoprene foam; polypropylene (PP) foam, including expanded polypropylene (EPP) and polypropylene paper (PPP); polystyrene (PS) foam; polyurethane (PU) foam such as sorbothane; polyvinyl chloride (PVC) foam; silicone foam, and microcellular foam.

Figure 3A:
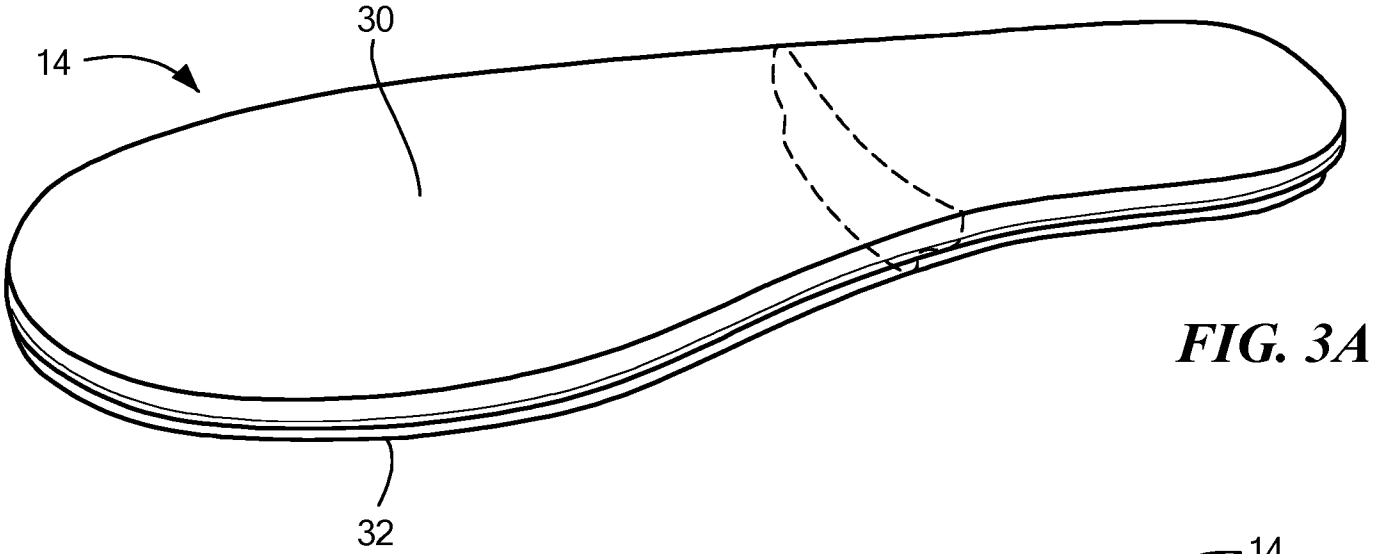
FIG. 3A is a top perspective view of the insole of the shoe of FIG. 1.
Figure 3B:
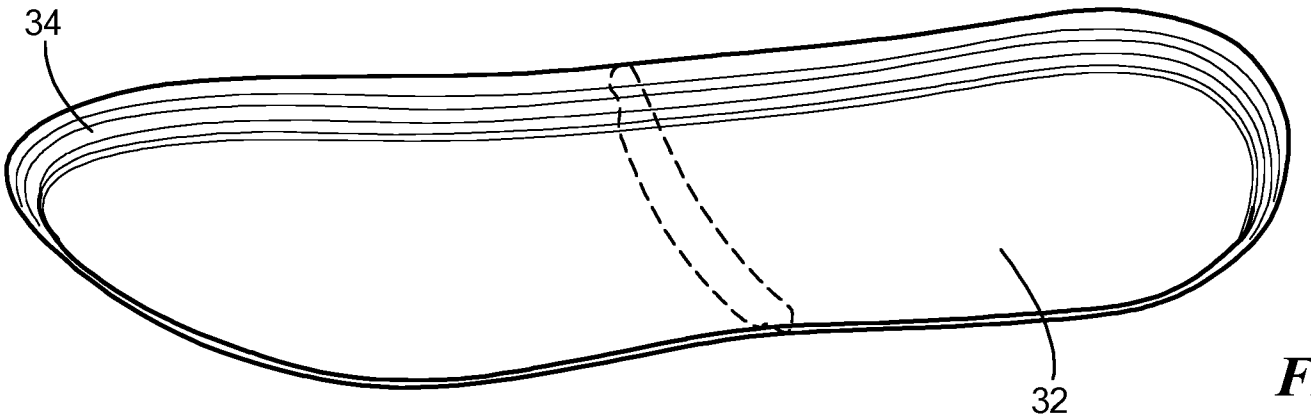
FIG. 3B is a bottom perspective view of the insole of the shoe of FIG. 1.
Figure 4A:
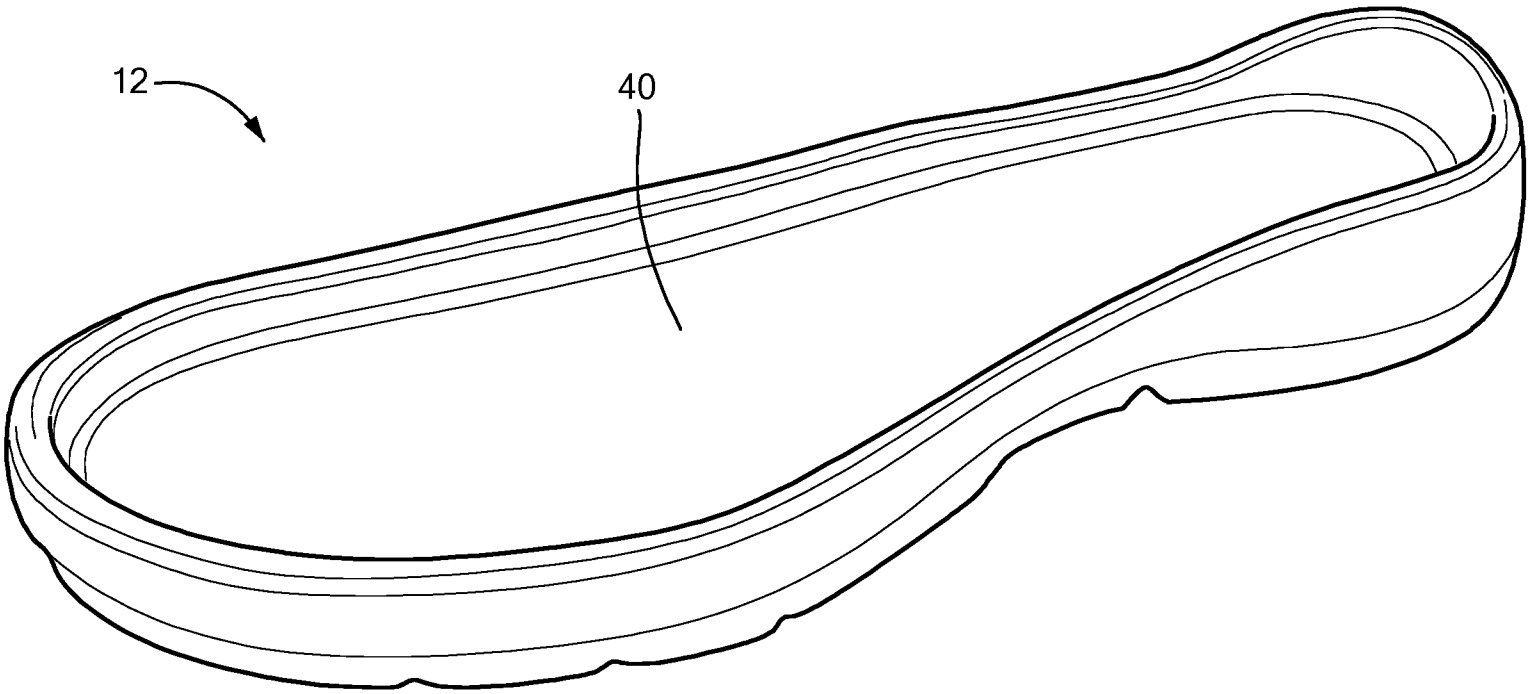
FIG. 4A is a top perspective view of the outsole of FIG. 1.
Figure 4B:
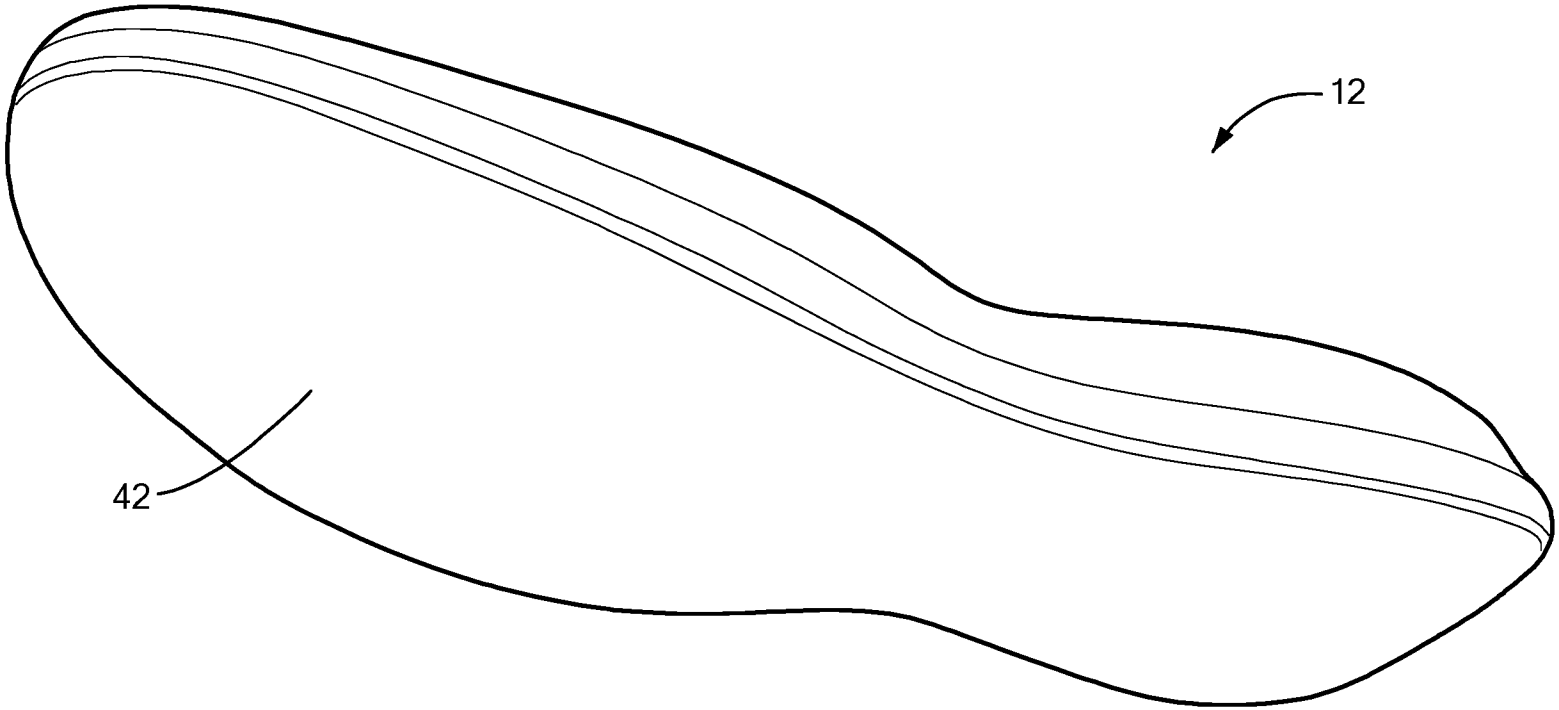
FIG. 4B is a bottom perspective view of the outsole of FIG. 1.

As illustrated in FIGS. 3A and 3B, insole 14 has an upper surface 30 and a lower surface 32. Lower surface 32 features a recess 34 along its perimeter for receiving the outer edge 18 of upper 16. FIGS. 4A and 4B illustrate the upper surface 40 and lower surface 42 of outsole 12, respectively. In another example embodiment, the recess for receiving the outer edge 18 of upper 16 may be placed along the perimeter of upper surface 40. In a further embodiment, both lower surface 32 and upper surface 40 may each feature a recess on their respective perimeters, where the recesses match to form an indentation for receiving the outer edge 18.

Surprisingly, it has been found that the absence of a midsole does not compromise shoe performance or comfort when the material(s) of the outsole and insole have durometer readings and a $T_1$:$T_2$ ratio within the ranges disclosed above. Hence, in a representative embodiment, the upper surface 40 of the outsole is directly fastened to the bottom surface 32 without a midsole being placed between the outsole and insole. The fastening of the outsole and insole can be realized with different known methods which are appropriate for effecting a durable yet sufficiently flexible and resilient connection. In this context, conventional methods include stitching, sewing, thermal bonding, ultrasonic bonding, laser bonding, adhesive bonding, mechanical connectors, and combinations thereof.

It has also been found that the shoe architecture of the present application can achieve a drop in wear and an increase in comfort by shaping the bottom surface 42 to be outwardly curved, in other words by shaping the bottom surface 42 of the outsole to include a rocker shape. The rocker shape preferably extends over the heel portion of the outsole. In other embodiments, the rocker shape may include the entire outsole or may be limited to the heel and forefoot portions of the outsole. This latter configuration is exemplified in FIG. 1, where the forefoot end forms an outwardly curved arch between points 11 and 13, the heel end forms an outwardly curved arch between points 15 and 17, and the middle section between points 13 and 15 is substantially flat.

A number of the foregoing innovations may be combined in an example shoe featuring an injection molded outsole of a first material having a durometer reading of at least 28 to at most 38 on the Asker C scale, an injection molded insole of a second material having a durometer reading of at least 28 to at most 38 on the Asker C scale, and an upper, where the peripheral edge of the upper is sandwiched between the insole and the outsole. The ratio T1:T2 preferably is at most 2:1 to at least 1:2, and the upper surface of the outsole preferably is fastened to the lower surface of the insole with an adhesive. As anticipated above, the shoe does not require a sock liner, a midsole, or a hard layer attached to the lower surface of the outsole, but may however include other parts which do not materially alter its properties and functionality.

As previously indicated, at least a portion of the outer edge 18 of upper 16 is sandwiched between outsole 12 and insole 14. In representative embodiments, the upper 16 is made of an elastomeric material. The combination of an elastomeric upper 16 with an outsole 12 and insole 14 of a durometer as recited above offers exceptional foot comfort. Example elastomeric materials include: unsaturated rubbers such as natural polyisoprene (cis-1,4-polyisoprene natural rubber (NR) and trans-1,4-polyisoprene gutta-percha); synthetic polyisoprene (IR for isoprene rubber); polybutadiene (BR for butadiene rubber); chloroprene rubber (CR), such as polychloroprene, neoprene, and baypren; butyl rubber (copolymer of isobutylene and isoprene, IIR); halogenated butyl rubbers (chloro-butyl rubber: CIIR; bromo-butyl rubber: BIIR); styrene-butadiene rubber (copolymer of styrene and butadiene, SBR); nitrile rubber (copolymer of butadiene and acrylonitrile, NBR); hydrogenated nitrile rubbers (HNBR); saturated rubbers such as: EPM rubber (ethylene propylene rubber, a copolymer of ethylene and propylene); EPDM rubber (ethylene propylene diene rubber, a terpolymer of ethylene, propylene and a diene-component); epichlorohydrin rubber (ECO); polyacrylic rubber (ACM, ABR); silicone rubber (SI, Q, VMQ); fluorosilicone rubber (FVMQ); fluoroelastomers (FKM, and FEPM); perfluoroelastomers (FFKM); polyether block amides (PEBA); chlorosulfonated polyethylene (CSM); ethylene-vinyl acetate (EVA); thermoplastic elastomers such as: styrenic block copolymers (TPE-s); thermoplastic olefins (TPE-o); elastomeric alloys (TPE-v or TPV); thermoplastic polyurethanes (TPU); thermoplastic copolyester (TPE-E); thermoplastic polyamides; and other types of elastomers, including: resilin; elastin; polysulfide rubber; and elastolefin.

Also as recited above, at least a portion of the outer edge 18 of upper 16 is sandwiched between the outsole 12 and insole 14, where either or both outsole 12 and insole 14 may feature a recess for receiving the edge 18. The edge 18 and optionally other parts of the upper 16 may be fastened to either or both outsole 12 and insole 14 by stitching, sewing, thermal bonding, ultrasonic bonding, laser bonding, adhesive bonding, mechanical connectors, and combinations thereof. Example adhesives include polyurethanes, polyesters, polyacrylates, polyamides, and mixtures thereof.

In an exemplary method for manufacturing a shoe according to the present application, an outsole is formed by injection molding a first material having a durometer reading of at least 28 to at most 38 on the Asker C scale, and an insole is formed by injection molding of a second material having a durometer reading of at least 28 to at most 38 on the Asker C scale. One or both of the first material and second material may be a polymeric foam. The outsole and insole are then fastened together and at least a section of the peripheral edge of an upper is sandwiched between the insole and the outsole. At least one of an upper surface of the outsole and a lower surface of the insole may have a recess for receiving the peripheral edge of the upper. The fastening of the outsole and insole can be realized with different known methods including stitching, sewing, thermal bonding, ultrasonic bonding, laser bonding, adhesive bonding, mechanical connectors, and combinations thereof. Example adhesives include polyurethanes, polyesters, polyacrylates, polyamides, and mixtures thereof.

The embodiments of the invention described above are intended to be merely exemplary; numerous variations and modifications will be apparent to those skilled in the art. All such variations and modifications are intended to be within the scope of the present invention as defined in any appended claims. Furthermore, disclosed aspects, or portions of these aspects, may be combined in ways not listed above. In addition, embodiments disclosed herein may be suitably practiced, absent any element that is not specifically disclosed herein.

What is claimed is:

1. An article of footwear comprising:

an injection molded outsole of a first material, constituting a single layer, having a durometer reading of at least 28 to at most 38 on the Asker C scale, an injection molded insole of a second material, constituting a single layer, having a durometer reading of at least 28 to at most 38 on the Asker C scale, and an upper, at least a section of a peripheral edge of the upper being sandwiched between the insole and the outsole, wherein the first material and the second material are polymeric foams, and wherein the article of footwear is devoid of a midsole between the outsole and the insole.

2. The article of footwear of claim 1, where a ratio $T_1$:$T_2$ is at most 2:1 to at least 1:2, $T_1$ being a thickness of the insole and $T_2$ being a thickness of the outsole.

3. The article of footwear of claim 1, where an upper surface of the outsole is fastened to a lower surface of the insole.

4. The article of footwear of claim 3, where the upper surface of the outsole is fastened to the lower surface of the insole with an adhesive.

5. The article of footwear of claim 1, where a lower face of the outsole has a rocker shape.

6. The article of footwear of claim 1 being devoid of a hard layer under the outsole.

7. The article of footwear of claim 1 being devoid of a sock liner.

8. The article of footwear of claim 1, where the upper is of an elastomeric material.

9. An article of footwear consisting essentially of:

an injection molded outsole of a first material, constituting a single layer, having a durometer reading of at least 28 to at most 38 on the Asker C scale, an injection molded insole of a second material, constituting a single layer, having a durometer reading of at least 28 to at most 38 on the Asker C scale, and an upper, at least a section of a peripheral edge of the upper being sandwiched between the insole and the outsole, wherein the first material and the second material are polymeric foams, and wherein the article of footwear is devoid of a midsole between the outsole and the insole.

10. The article of footwear of claim 9, where at least one of an upper surface of the outsole and a lower surface of the insole has a recess for receiving the peripheral edge of the upper.

11. An article of footwear comprising:

an injection molded outsole of a material having a durometer reading of at least 28 to at most 38 on the Asker C scale, an injection molded insole of the material, and an upper, at least a section of a peripheral edge of the upper being sandwiched between the insole and the outsole, wherein the material is a polymeric foam, and wherein the article of footwear is devoid of a midsole between the outsole and the insole.

* * * * *